US009132442B2

(12) United States Patent
Yan et al.

(10) Patent No.: US 9,132,442 B2
(45) Date of Patent: Sep. 15, 2015

(54) DIAGNOSIS AND CONTROLS OF A FLUID DELIVERY APPARATUS WITH HYDRAULIC BUFFER

(71) Applicants: Mi Yan, Columbus, IN (US); Baohua Qi, Columbus, IN (US)

(72) Inventors: Mi Yan, Columbus, IN (US); Baohua Qi, Columbus, IN (US)

( * ) Notice: Subject to any disclaimer, the term of this patent is extended or adjusted under 35 U.S.C. 154(b) by 487 days.

(21) Appl. No.: 13/674,030

(22) Filed: Nov. 10, 2012

(65) Prior Publication Data

US 2014/0131473 A1 May 15, 2014

(51) Int. Cl.

| | |
|---|---|
| ***B05B 12/00*** | (2006.01) |
| ***B05B 12/08*** | (2006.01) |
| ***F02M 57/00*** | (2006.01) |
| ***B05B 7/24*** | (2006.01) |
| *F02M 63/02* | (2006.01) |
| *F01N 11/00* | (2006.01) |
| *F02M 55/04* | (2006.01) |
| *F02M 37/00* | (2006.01) |

(52) U.S. Cl.

CPC ..... *B05B 12/085* (2013.01); *B05B 7/2416* (2013.01); *B05B 12/006* (2013.01); *B05B 12/008* (2013.01); *F02M 57/005* (2013.01); *F01N 11/00* (2013.01); *F01N 2550/05* (2013.01); *F01N 2610/02* (2013.01); *F02M 37/0076* (2013.01); *F02M 55/04* (2013.01); *F02M 63/0225* (2013.01)

(58) Field of Classification Search

CPC .. B05B 12/004; B05B 12/006; B05B 12/008; B05B 12/08; B05B 12/085; B05B 12/087; F02M 57/005; F02M 2200/247; F02D 41/3836; F02D 2200/0602

See application file for complete search history.

(56) References Cited

U.S. PATENT DOCUMENTS

| | | | | |
|---|---|---|---|---|
| 4,619,240 | A * | 10/1986 | Bedford et al. | 123/575 |
| 4,627,403 | A * | 12/1986 | Matsumura | 123/447 |
| 5,152,271 | A * | 10/1992 | Matsumura | 123/504 |
| 5,520,333 | A * | 5/1996 | Tofte | 239/10 |
| 2009/0082941 | A1 * | 3/2009 | Nakata et al. | 701/103 |
| 2009/0084356 | A1 * | 4/2009 | Nakata et al. | 123/447 |
| 2010/0268441 | A1 * | 10/2010 | Yoshiume | 701/103 |

* cited by examiner

*Primary Examiner* — Ryan Reis

(57) ABSTRACT

A fluid delivery apparatus for delivering fluid according to a fluid delivery rate command including a fluid tank, a pump, a buffer, in which a pressure sensor is positioned, an injector, a pump controller, a fluid delivery controller, and a diagnostic controller. When a motor driven pump is used, the diagnostic controller is able to detect issues by comparing a measured pressure change with an expected value calculated using pressure sensing values and the power applied to the motor. If an air driven pump is employed, pressure sensing values, fluid delivery rate commands, and pump operating status can be used for calculating compressed air volume in the pump and trapped air volume in the buffer, and for further triggering pressing and suction strokes of the air driven pump, diagnosing issues in the fluid delivery apparatus, detecting fluid level in the fluid tank, and refilling trapped air in the buffer.

20 Claims, 12 Drawing Sheets

DIAGNOSIS AND CONTROLS OF A FLUID DELIVERY APPARATUS WITH HYDRAULIC BUFFER

This present application claims priority from U.S. provisional application No. 61/629,035 having the same title as the present invention and filed on Nov. 10, 2011.

FIELD OF THE INVENTION

The present invention relates to fluid delivery apparatus, and more particularly to methods and apparatus for controlling and diagnosing a fluid delivery apparatus with a hydraulic buffer.

BACKGROUND OF THE INVENTION

Fluid delivery is needed in a variety of applications, e.g. medicine delivery in medical devices, fuel injection in internal combustion engines, and reductant delivery in engine exhaust gas treatment systems. To accurately deliver required amount of fluid, in a fluid delivery apparatus, normally fluid needs to be metered, and the metering methods can be either a pre-metering method, in which the amount of the fluid to be delivered is metered before delivered, or a common rail method, in which the fluid is contained in a common rail with its pressure controlled, and the metering is achieved by controlling the opening time of a nozzle fluidly connected to the common rail during delivery. In the pre-metering method, since the fluid pressure is not controlled, without an assistant means, e.g. compressed air, it is difficult to satisfy both of delivery rate and atomization requirements, which need the fluid pressure be controlled in a certain range. Also, limited to metering accuracy and speed, it is also difficult for a pre-metering method to rapidly change fluid delivery rate. In the common rail method, the pressure of the common rail is controlled to a constant value. Thereby it is relatively easy to achieve both delivery rate and atomization requirements. And since the fluid delivery rate is determined by the opening time of the nozzle, with a high common rail pressure and fast-response nozzle control, fluid delivery rate can be changed quickly. However, in the common rail method, if a rigid common rail is used, the suddenly opening of the nozzle may create a pressure spike, causing problems in common rail pressure control and fluid delivery rate control. To solve this problem, normally a hydraulic buffer is used with the common rail for damping pressure change. The hydraulic buffer and common rail can be the same device and two types of hydraulic buffers are normally used. One type hydraulic buffer is a spring buffer that has a spring inside providing a linear relation between pressure change and volume change and the proportional coefficient is determined by the spring constant. The other type hydraulic buffer has air trapped inside. The volume change of the trapped air damps the pressure change. In addition to smoothing pressure change, the hydraulic buffer can also provide pressing force when fluid supply to the hydraulic buffer interrupts, e.g. when a membrane pump or an air-driven pump is used in supplying fluid.

The fluid to be delivered may have certain solubility for the trapped air in a hydraulic buffer, and normally the higher the pressure, the higher the solubility is. If such a fluid is delivered, the trapped air may be brought out by the fluid, resulting in poor delivery performance. One method for solving this problem is refilling air when the trapped air is exhausted. However, the air refilling needs to be carefully controlled, since too much refilling air would enter the fluid to be delivered and cause delivery rate issues. Controlling air refill without increasing control system complexity is a challenging problem.

Control system complexity is also a concern in pump controls, especially in the control of an air-driven pump. When an air-driven pump is used for supplying fluid, a two-stroke control can be used in controlling the pressure in the buffer, i.e., in a suction stroke when the compressed air in the pump is released, fluid flows into the pump and in a pressing stroke when compressed air goes in the pump, a pressure is built up to provide a driving force for fluid delivery. In switching between these two strokes, the fluid level in the pump and the buffer is normally used in triggering the change of the strokes. However positioning fluid level sensors in the pump and the buffer will increase system complexity and fluid sloshing may introduce errors in fluid level sensing and cause control problems. It is desirable to use as few sensors as possible in the stroke control.

Decreasing control system complexity also benefits system diagnosis. In applications that require high reliability, such as that in medical instruments and engines, the fluid delivery performance needs to be monitored, and a fault is reported when an anomaly is detected to avoid failures in the fluid delivery apparatus from causing other issues. For example, engine controls require on-board diagnostics (OBD), which need to report a fault when a problem is detected. On one hand, to better monitor the fluid delivery performance, more sensing information is beneficial. On the other hand, however, more sensors may create more issues and hence need more diagnostics for themselves. Therefore, it is better obtaining more information from fewer sensors in detecting system issues. And it would be more desirable to use one sensor for multiple sensings.

In addressing the issues and requirements mentioned above, the present invention provides a fluid delivery apparatus with a diagnostic controller that detects issues in delivering fluid with a single pressure sensor positioned in the buffer of the fluid delivery apparatus. The present invention also provides a controller for an air driven pump switching in between a suction stroke and a pressing stroke, and a controller for refilling trapped air in a buffer and a tank fluid level sensing means using the sensing value obtained from the pressure sensor. Additionally, based on the pressure sensor, the present invention further provides a sensing means for detecting fluid level in a tank of the fluid delivery apparatus.

BRIEF SUMMARY OF THE INVENTION

In one aspect of the invention, a diagnostic controller is provided for a fluid delivery apparatus with a motor driven pump to detect issues in delivering fluid. The diagnostic controller may use the sensing value obtained from a pressure sensor positioned in the buffer of the fluid delivery apparatus, and the applied power to the motor driven pump, which can be calculated using the applied voltage and current. In an embodiment of the diagnostic controller, firstly the applied power together with the pressure sensor value and the required fluid delivery rate are screened to remove invalid signals, and then the rationality of the fluid delivery apparatus is examined by comparing estimated pressure change and measured pressured change values in the buffer. A fault is generated when the estimated value doesn't agree with the measured value. This diagnostic controller can be used for both of the apparatus with a spring buffer, in which fluid volume change is proportional to the change in pressure, and that with a buffer having air trapped inside.

In another aspect of the invention, a diagnostic controller is provided for a fluid delivery apparatus with an air driven pump, which operates alternately with a suction stroke and a pressing stroke. In an embodiment of the diagnostic controller, the pressure sensing values are obtained from a pressure sensor positioned in the buffer of the fluid delivery apparatus, and the ratio of the pressure sensing value obtained when the delivery nozzle of the fluid delivery apparatus is open to that obtained with the delivery nozzle closed is calculated. The ratio value is then compared to an upper threshold value and a lower threshold value. If the ratio value is higher than the upper threshold value or lower than the lower threshold value, then a fault is generated. The diagnostic controller can be used for the fluid delivery apparatus with both of a spring buffer or a buffer with air trapped. For the fluid delivery apparatus with a spring buffer, another diagnostic controller is further provided to detect issues in the fluid delivery path from the buffer to the nozzle. In an embodiment of this diagnostic controller, the ratio of the buffer pressure change to the amount of the fluid delivered during the buffer pressure change is calculated, and a fault is reported when the calculated ratio value is out of a range determined by an upper threshold value and a lower threshold value.

Yet in another aspect of the invention, a pump controller is provided for a fluid delivery apparatus with an air driven pump to switch from a pressing stroke to a suction stroke. In an embodiment of the controller, the compressed air volume in the pump is calculated. If the calculated volume value is higher than a threshold, then a suction stroke is triggered. Another pump controller is provided for the fluid delivery apparatus to switch from a suction stroke to a pressing stroke. In an embodiment of this pump controller, the pressure sensing value is compared to a threshold value in triggering a pressing stroke for the fluid apparatus with a spring buffer, and in the fluid apparatus with a buffer having air trapped inside, the volume of the trapped air in the buffer is calculated. A pressing stroke is triggered when the calculated volume value is above a threshold.

Yet in another aspect of the invention, a fluid level sensing means is provided for measuring the fluid level in a tank of a fluid delivery apparatus with an air driven pump, using the pressure sensing value obtained in a suction stroke. In an embodiment of this fluid level sensing means, after a pressing stroke, the compressed air volume in the air driven pump is calculated. The fluid level in the tank is then calculated using the compressed air volume value together with the delivered fluid amount from the beginning of the suction stroke to the moment when the volume of compressed air is calculated, and the duration time of the suction stroke.

Yet in another aspect of the invention, a refill controller is provided to refill trapped air in a buffer of a fluid delivery apparatus with an air driven pump. In an embodiment of the refill controller, the trapped air volume in the buffer is calculated, and the ratio of the current pressure sensing value to the calculated trapped air volume is compared to a threshold value. Air is refilled into the buffer if the calculated ratio value is higher than the threshold value.

DETAILED DESCRIPTION OF THE INVENTION

Figure 1:
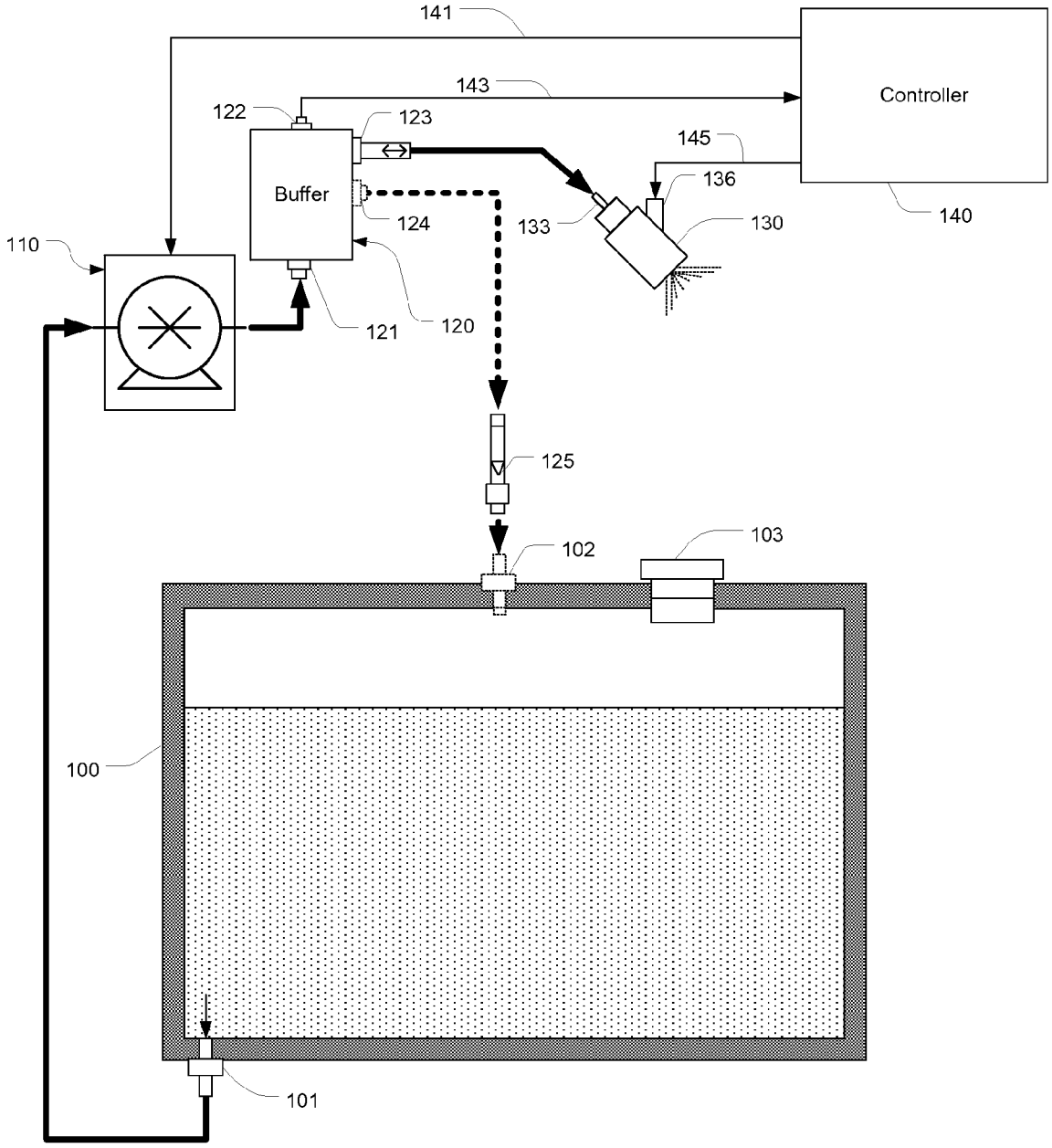
FIG. 1 is a schematic representation of a fluid delivery apparatus with a controller.

Referring to FIG. 1, a common-rail fluid delivery apparatus includes a tank 100 containing the fluid filled through an opening in the top of the tank covered by a cap 103. A pump 110, which is controlled by a controller 140 through signal lines 141, draws fluid from the tank 100 through a port 101 of the tank 100, and delivers the fluid into a buffer 120 via a port 121 of the buffer, where fluid pressure is built up and maintained to a certain level. A pressure sensor 122 reports the pressure inside the buffer 120 to the controller 140 through signal lines 143 for controlling the fluid pressure in the buffer, and under the buffer pressure, part of the fluid in the buffer goes into an injector 130 through a port 123 of the buffer and a port 133 of the injector, and part of the fluid is released back the tank 100 through an optional port 124 of the buffer, an orifice 125 and an optional port 102 of the tank. The injector 130 is controlled by the controller through lines 145 connected to a port 136. When the injector is energized, the injector nozzle is opened, and fluid is discharged out, otherwise, when the injector is de-energized, the injector nozzle is closed, and fluid is kept inside the injector. By controlling the opening time of the nozzle, fluid discharging amount can be controlled.

The function of the buffer 120 is to damp the pressure change caused by the actions of the injector and the pump. An embodiment of the buffer 120 is a spring buffer shown in FIG. 2. The spring buffer includes a cylinder 201 with a cap 205 screwed on its top end and a cap 207 screwed on its bottom end. Inside the cylinder, a spring 202 is positioned in between the cap 207 and a piston 203, the uppermost position of which is limited by the cap 205. With the piston 203, a high pressure chamber 220 is enclosed in the cylinder 201, and an o-ring 204 in a groove 206 of the piston 203 seals fluid in the high pressure chamber 220 from leaking out. The pressure in the chamber 220 is reported to the controller 140 (FIG. 1) by the pressure sensor 122. And inside the port 121, a check valve 211 keeps fluid inside the buffer from flowing back to the pump 110 (FIG. 1) (when a membrane pump is used, the check valve is not necessary). The pressure sensor 122 and the ports 121, 123, and 124 are fluidly connected through a passage 209 in the cap 205, which is further fluidly connected to the chamber 220 via a passage 212. In case fluid leaks through the piston 203 and the o-ring 204, the leaked fluid flows back to the tank through a port 208 (fluid passage not shown).

According to Hook's law, the spring buffer provides a relation between the change of the fluid volume inside the chamber 220, $dV_c$, and the change of fluid gauge pressure $dP_c$:

$$dP_c=K_s dV_c/A_p^2, \tag{1}$$

wherein $K_s$ is the spring constant, and $A_p$ is the area of the piston surface exposed in the chamber 220. For an incompressible fluid, the volume change $dV_c$ is further a function of the flow rate of the fluid charged into the chamber 220 and that discharged from the chamber:

$$dV_c=(\dot{m}_1-\dot{m}_{o1}-\dot{m}_{o2})dt/\rho, \tag{2}$$

where $\dot{m}_1$ is the mass flow rate of the fluid charged into the chamber 220 through the port 123; $\dot{m}_{o1}$ and $\dot{m}_{o2}$ are, respectively, the mass flow rate of the fluid discharged from the chamber through the ports 122 and 124, and ρ is the density of the fluid. When a motor driven pump is used, the mass flow rate $\dot{m}_1$ is a function of the voltage applied to the motor, $V_m$, the current applied to the motor, $I_m$, and the system head, h, of the pump:

$$\dot{m}_1=V_m I_m \eta_m/gh, \tag{3}$$

where $\eta_m$ is the pump efficiency, and g is the acceleration of gravity. For a given pump and fluid, the pump efficiency is determined by the mass flow rate $\dot{m}_1$ and the system head h with a pump efficiency curve, and the system head h is further a function of the mass flow rate $\dot{m}_1$ and the gauge fluid pressure in the chamber, $P_c$, when the pressure caused by height difference between the tank 100 (FIG. 1) and the pump 110 is neglected, and the tank is not sealed from ambient:

$$h=P_c/\rho g+K_m\dot{m}_1^2, \tag{4}$$

where $K_m$ is a constant determined by the properties of the pump and fluid. Accordingly, for a given pump and fluid, with the applied voltage and current to the pump, $V_m$, and $I_m$, and the gauge fluid pressure $P_c$, which can be measured using the pressure sensor 122, the mass flow rate $\dot{m}_1$ can be determined therewith according to a relation governed by equations (3) and (4):

$$\dot{m}_1=f(V_m I_m, P_c) \tag{5}$$

Referring back to equation (2), the mass flow rate $\dot{m}_{o1}$ in the equation is the fluid delivery rate through the injector 130 (FIG. 1). When the injector nozzle is open, the mass flow rate $\dot{m}_{o1}$ is determined by the pressure $P_c$, assuming the fluid is delivered to an environment with ambient pressure:

$$\dot{m}_{o1}=C_1 A_{n1}\sqrt{2\rho P_c}, \tag{6}$$

where $C_1$ is the orifice flow coefficient of the injector, and $A_{n1}$ is the minimum cross-section area of the injector nozzle. Similarly, the mass flow rate $\dot{m}_{o2}$ is also a function of the pressure $P_c$:

$$\dot{m}_{o2}=C_2 A_{n2}\sqrt{2\rho P_c}, \tag{7}$$

where $C_2$ is the orifice flow coefficient of the releasing nozzle 125 (FIG. 1), and $A_{n2}$ is the minimum cross-section area of the releasing nozzle.

Combining equations (1), (2), (5)-(7), a relation among the pressure $P_c$, the pressure changing rate $dP_c/dt$, and the power applied to the motor, $V_m I_m$, can be obtained:

$$dP_c/dt=[f(V_m I_m, P_c)-(C_1 A_{n1}+C_2 A_{n2})\sqrt{2\rho P_c}]K_s/\rho A_p^2 \tag{8}$$

Supposing the fluid delivery apparatus works normally, i.e., a delivery command of $D_c$ can be achieved accurately:

$$D_c=C_1 A_{n1}\sqrt{2\rho P_c}, \tag{9}$$

then according to equation (8), we have $$dP_c/dt=[f(V_m I_m, P_c)-D_c-C_2 A_{n2}\sqrt{2\rho P_c}]K_s/\rho A_p^2 \tag{10}$$

Observing the pressure $P_c$ for a period of time T, the following equation can be obtained according to equation (10):

$$P_c(T)-P_c(0)=\int_0^T[f(V_m I_m, P_c)-P_c-C_2 A_{n2}\sqrt{2\rho P_c}]K_s/\rho A_p^2 dt \tag{11}$$

The equations (10) and (11) are valid when the measurements of $V_m$, $I_m$ and $P_c$ are accurate, and the actual fluid delivery rate equals to the command. Therefore, by examining the validity of equation (10) or (11), measurement issues and delivery problems can be detected.

Figure 3A:
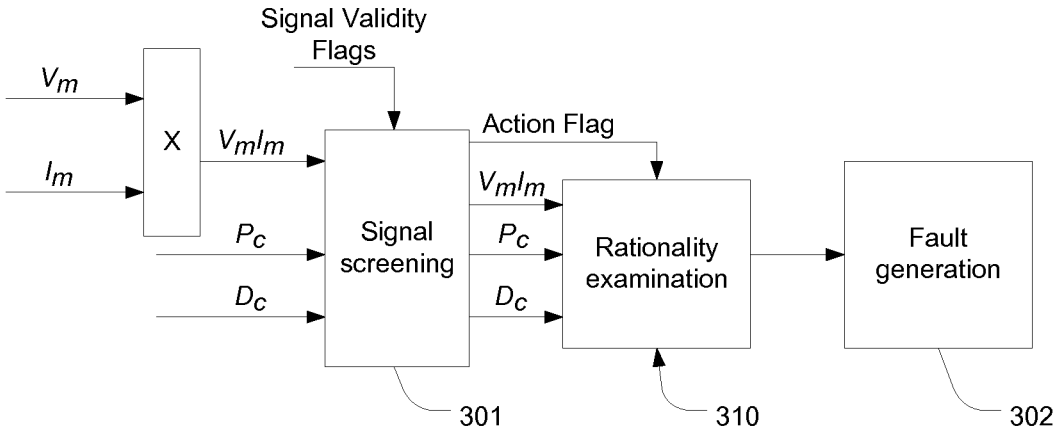
FIG. 3*a* is a block diagram of a diagnostic controller that detects issues in a fluid delivery apparatus with a motor driven pump.

The block diagram of a diagnostic algorithm based on equation (11) is shown in FIG. 3*a*. In this algorithm, the applied power to the motor is calculated with the applied voltage $V_m$ and measured current $I_m$, and the result value, $V_m I_m$, is sent to a signal screening block 301 together with the pressure $P_c$, the fluid delivery command $D_c$, and signal validity flags including the validity flags of signals $V_m$, $I_m$ and $P_c$, and the validity flag of the fluid delivery apparatus excluding the validity flag generated by this algorithm. In the signal screening block, the validity of signals $V_m$, $I_m$, $P_c$, and $D_c$ are examined and the value of each signal is compared to a predetermined range. The validity check is to avoid issues caused by invalid signal values, while the value check is to increase diagnostic reliability, since higher uncertainty could be introduced when signal values are out of a certain range. In the validity check, an Action flag, which can be an Enable Flag, an Abort flag, or a Pause flag, is generated: when the values of $V_m I_m$, $P_c$, and $D_c$ are within their predetermined range, and all signals are valid, an Enable flag is generated, otherwise, if the validity flags show an invalid signal, an Abort flag is generated; if all signals are valid and some of the signal values are out of their predetermined range, or signal values are not available, then a Pause flag is generated. The Action Flag together with the values of $V_m I_m$, $P_c$, and $D_c$ are sent to a Rationality examination block 310. In this block, the rationality of the fluid delivery apparatus is examined and the result is sent to a fault generation block 302, where a fault is generated if an issue is detected.

Figure 3B:
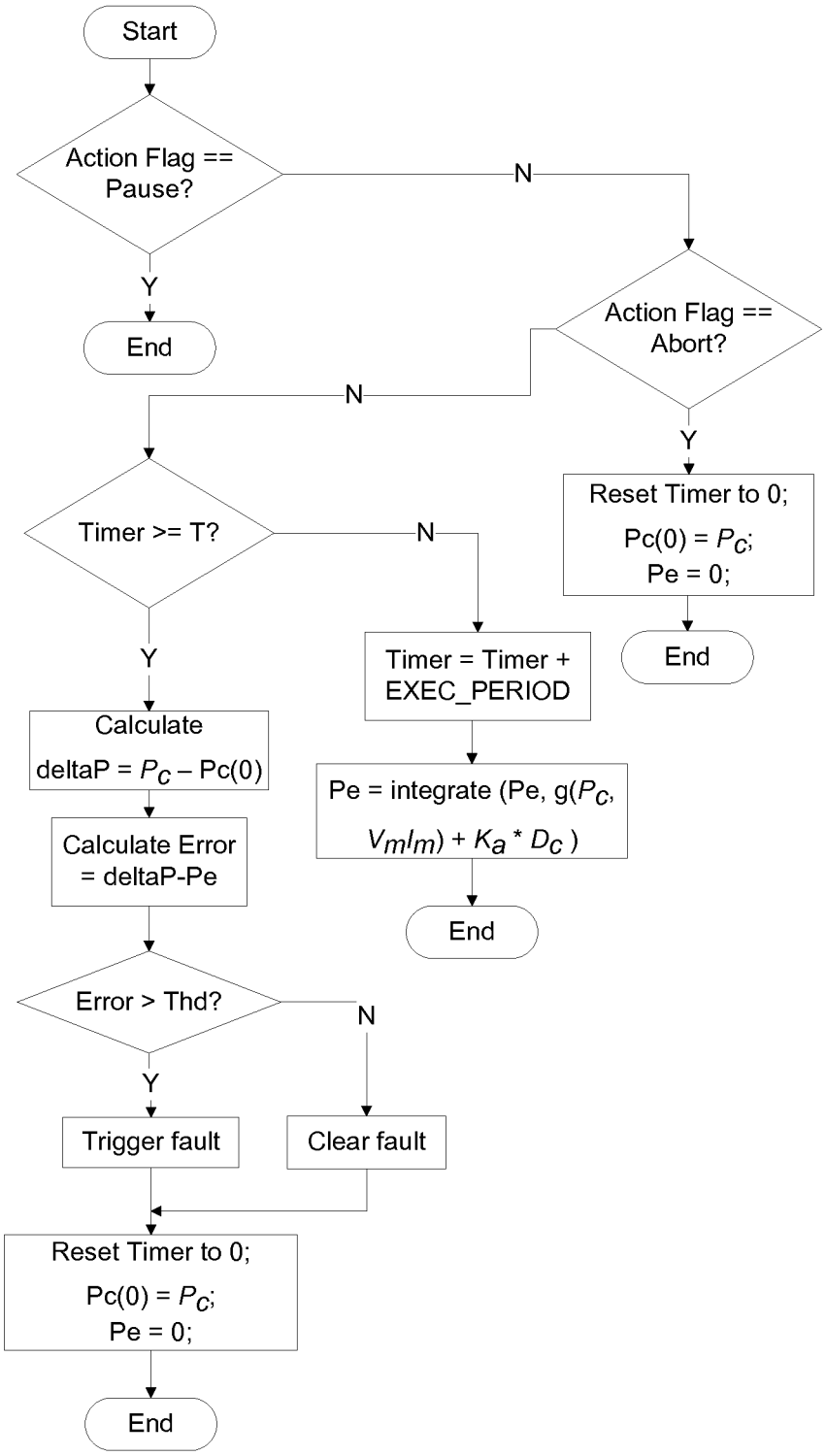
FIG. 3*b* is a flow chart of an interrupt service routine that realizes the function of the Rationality examination block in FIG. 3*a;*

The rationality examination block 310 can be realized by an interrupt service routine, which is periodically triggered by a timer interrupt. Referring to FIG. 3*b*, after the routine starts, the Action Flag value is examined. If a Pause flag is detected, then the routine ends, otherwise, if an Abort flag is detected, variables Timer and Pe are reset to 0, and the current value of $P_c$ is assigned to Pc(0), and then the routine ends. If either an Abort nor a Pause flag is detected, then the value of Timer is checked. If it is lower than a constant T, then the error between deltaP, which is the difference value between $P_c$ and Pc(0), and Pe is calculated. If the error is higher than a threshold, Thd, then a fault is triggered, otherwise, the fault is cleared. The routine resets Timer and Pe, and assigns the value of $P_c$ to Pc(0) before it ends. In checking the value of Timer, if it is not lower than the constant T, then the value of Timer is added with a constant, EXEC_PERIOD, which is the execution period value of the routine. Then before the routine ends, Pe is integrated with a differential term $g(P_c, V_m I_m)+K_a*Dc$ according to equation (11), where $$g(P_c, V_m I_m)=[f(V_m I_m P_c)-C_2 A_{n2}\sqrt{2\rho P_c}]K_s/\rho A_p^2$$

, and $$K_a=K_s/\rho A_p^2$$

A simple Euler integration can be used in the calculation of Pe, i.e, $$Pe=Pe+(g(P_c, V_m I_m)-K_a*D_a)*\text{EXE_PERIOD}, \quad (12)$$

and in the differential term, the function $g(P_c, V_m I_m)$ can also be calculated using a two dimensional lookup table, the parameter values in which are populated from the results of a matrix test with different applied power and pressure levels.

Figure 4:
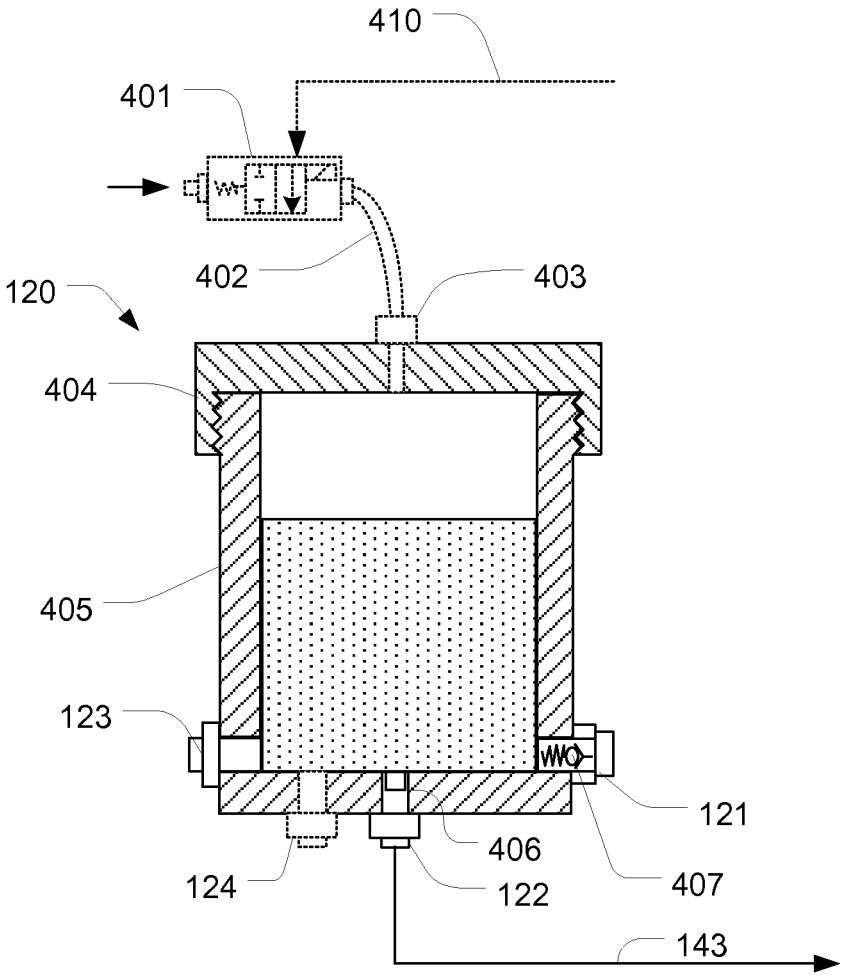
FIG. 4 is a diagrammatic and cross-sectional illustration of a buffer with air trapped inside.

In addition to spring buffers, air trapped buffers can also be used in the fluid delivery apparatus. Referring to FIG. 4, a simple air trapped buffer has a cylinder 405 with one end enclosed and a cap 404 screwed on the other end. On the cap 404, an optional port 403 is used to refill air to the cylinder 405 from a compressed air source (not shown in FIG. 4) through a solenoid valve 401 and a passage line 402. The solenoid valve 401 is controlled by the controller 140 (FIG. 1) via signal lines 410.

Figure 2:
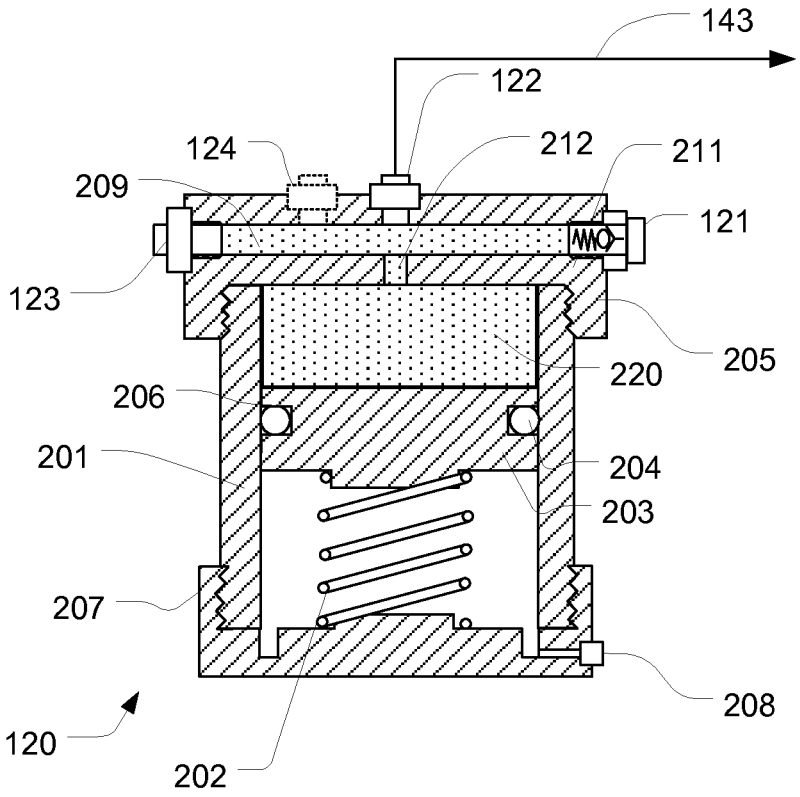
FIG. 2 is a diagrammatic and cross-sectional illustration of a spring buffer.

Different from the spring buffer of FIG. 2, the air trapped buffer of FIG. 4 is not able to provide a linear relation between the buffer gauge pressure $P_c$ and the fluid volume $V_a$ in the buffer. In fact, if the total volume of the buffer is $V_b$, then $$V_b=V_c+V_a, \quad (13)$$

where $V_a$ is the volume of trapped air, and $$P_c V_a=nRT_b, \quad (14)$$

where n is the amount of trapped air in moles; R is the gas constant, and $T_b$ is the gas temperature in the buffer. Assuming gas temperature is kept constant, then according to equation (13) and (14), $$dP_c = -\frac{nRT_b dV_a}{V_a^2} = \frac{nRT_b dV_c}{V_a^2} \quad (15)$$

Comparing equation (15) to equation (1), we can see that in the air trapped buffer of FIG. 4, the coefficient of the change in fluid volume $V_c$ is not a constant as that in the spring buffer of FIG. 2. It changes with the volume and the amount of trapped air. Typically, the amount of trapped air is initially determined in a priming process in which fluid flows into the buffer under the pressure provided by the pump and traps air in the buffer, or the trapped air is supplied by a compressed air source through the solenoid 401, the passage line 402, and the port 403. And the amount of trapped air keeps constant after the priming process if there is no air leakage and the fluid to be delivered has no solubility for the trapped air. The volume of the compressed air is affected by the temperature $T_b$ and the pressure $P_c$. The changes in the amount and the volume of the trapped air cause the coefficient change in equation (15). As a result, to use the equations (10) and (11) for system rationality examination, the parameter $K_s$ needs to be replaced with $K'_s$:

$$K'_s = \frac{nRT}{V_a^2} = \frac{P_c}{V_a} = \frac{dP_c}{dV_c} \quad (16)$$

If we know the volume of the trapped air $V_a$, e.g., by measuring fluid volume or level in the buffer, then with the pressure $P_c$, the coefficient $K'_s$ can be calculated directly according to equation (16). Another method for obtaining the value of $K'_s$ is calculating the change of fluid volume $V_c$ according to equations (2)-(7), and then calculating $K'_s$ according to equation (16).

Figure 5:
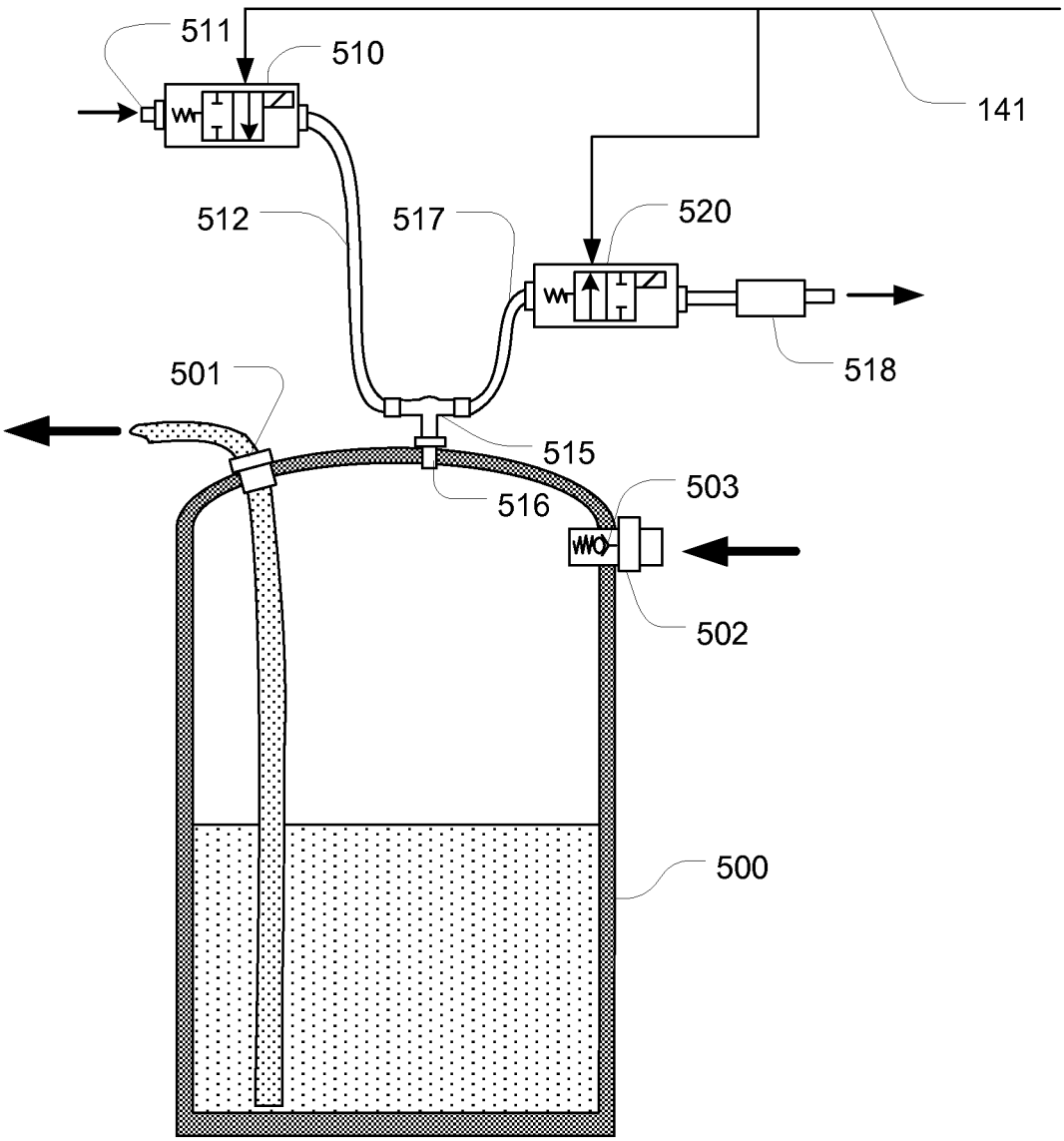
FIG. 5 is a diagrammatic and cross-sectional illustration of an air driven pump.

Referring back to FIG. 1, the pump 110 in the fluid delivery apparatus can also be an air driven pump as shown in FIG. 5. The air driven pump includes a pump body 500, in which fluid is contained. A port 502 on the pump body has a check valve 503 inside is fluidly connected to the port 101 of the tank 100 (FIG. 1), and another port 501 is fluidly connected to the port 121 of the buffer 120. A third port 516 is fluidly connected to the bottom port of a T connector 515, the side ports of which are fluidly connected to a NC (Normally Closed) solenoid valve 510 and a NO (Normally Open) solenoid valve 520 respectively through a passage line 512 and a passage line 517. The solenoid valve 510 is further fluidly connected to a compressed air source through a port 511. When the solenoid valve 510 is energized open, compressed air flows into the pump via the port 511, the solenoid valve 510, the air passage line 512, the T connector 515, and the port 516 of the pump. The solenoid valve 520 is fluidly connected to a muffler 518, and when the solenoid valve 520 is de-energized open, compressed air in the pump goes out through the port 516, the T connector 515, the air passage line 517, the solenoid valve 520, and the muffler 518. Both of the solenoid valves 510 and 520 are controlled by the controller 140 through the signal lines 141 (FIG. 1).

The air driven pump works with a suction stroke and a pressing stoke. In the suction stroke, the solenoid valve 510 is de-energized closed, and the solenoid valve 520 is de-energized open. Thereby compressed air is released, and fluid fills in the pump from the tank 100 (FIG. 1). In the pressing stroke, the solenoid valve 510 is energized open, while the solenoid valve 520 is energized closed. Compressed air fills in the pump and pressure is built up for the fluid in the pump. When a spring buffer of FIG. 2 or an air trapped buffer of FIG. 4 is used with the air driven pump of FIG. 5, in the pressing stroke, the pressure in the buffer is the same as that in the pump if the pressure drop across the check valve is neglected and the injector nozzle is closed, i.e., $$P_p=P_c=P_{c0}, \quad (17)$$

where $P_p$ is the fluid pressure in the pump, and $P_{c0}$ is the buffer pressure when the injector nozzle is closed and the pump fluid pressure $P_p$ and the buffer $P_{c0}$ are steady, i.e. $dP_p=0$ and $dP_{c0}=0$. When the injector nozzle is opened, then the pressure $P_p$ becomes a function of the buffer pressure, and the mass flow rate $\dot{m}_{o1}$ of the fluid delivered through the injector 130 (FIG. 1) when there is no fluid return path through the port 124:

$$\dot{m}_{o1}=C_3 A_{n3}\sqrt{2\rho(P_p-P_{c1})}, \quad (18)$$

where $A_{n3}$ is the minimum cross-section area in the fluid filling path from the pump to the buffer; $P_{c1}$ is the pressure $P_c$ after the injector 130 is energized open, and $C_3$ is the flow coefficient of the fluid filling path. According to the equations (6) and (18), when the buffer pressure $P_{c1}$ is steady, i.e., $dP_{c1}=0$, then we have:

$$P_p = \left[\left(\frac{C_1 A_{n1}}{C_3 A_{n3}}\right)^2 + 1\right]P_{c1} \quad (19)$$

The equations (17) and (19) show that if the pump pressure is kept constant, then buffer pressure decreases after the injector nozzle is opened, and the pressure change $\Delta P_c$ is $$\Delta P_c = P_{c0} - P_{c1} = K_r P_{c1}, \tag{20}$$

where $K_r$ is a constant, and $$K_r = \left(\frac{C_1 A_{n1}}{C_3 A_{n3}}\right)^2 = \frac{P_{c0}}{P_{c1}} - 1 \tag{21}$$

Figure 6A:
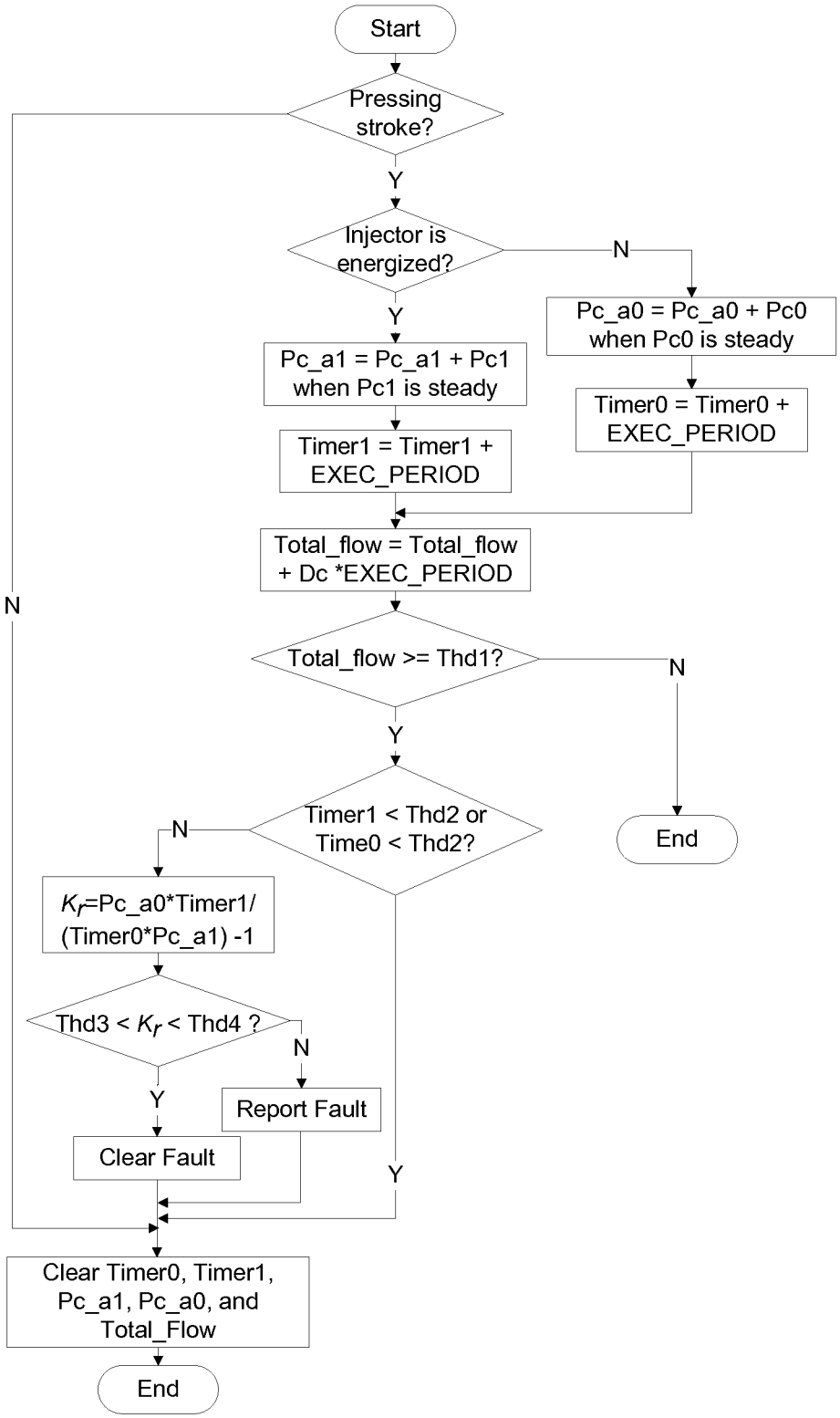
FIG. 6*a* is a flow chart of an interrupt service routine for a diagnostic controller to detect issues in a fluid delivery apparatus with an air driven pump.

The relation between the pressure change $\Delta P_c$ and the pressure $P_{c1}$ as indicated in equation (20) and (21) can be used in diagnosing issues in the injector control and the fluid passage path, including the fluid passage from the pump to the buffer and that from the buffer to the injector, when the pressure $P_p$ is controlled constant or when the fluid volume change in the pump is small and thereby the change in the pressure $P_p$ is small. An embodiment of the diagnosis method is an interrupt service routine as shown in FIG. 6*a*. The interrupt for this routine can be timer triggered, so that the routine runs periodically with a time interval of EXEC_PERIOD. Referring to FIG. 6*a*, after the routine starts, if the pump control is in a pressing stroke, then the injector status is checked. If the injector is energized, then the pressure sensing value $P_{c1}$ is added into a variable Pc_a1, and a timer, Timer1, is incremented by the time interval of EXEC_PERIOD when $P_{c1}$ is steady, otherwise, the pressure sensing value $P_{c0}$ is added into a variable Pc_a0, and another timer, Timer0, is incremented by EXEC_PERIOD when $P_{c0}$ is steady. The changing rate of the pressure sensing values can be used in determining if a steady status is reached: if the changing rate is lower than a threshold, then the sensing value is steady. After the calculation of Pc_a0 and Timer0, or Pc_a1 and Timer1, the total fluid flow, Total_flow, is calculated by integrating with the fluid injection amount, which is a product of the fluid injection rate command $D_c$ and the time interval EXEC_PERIOD, and its value is compared with a threshold, Thd1. If the value of the Total_flow is lower than Thd1, then the routine ends, otherwise, the Timer1 value and the Timer 0 value are compared with a threshold Thd2. The routine clears Timer0, Timer 1, Pc_a1, Pc_a0, and Total_Flow if the Timer1 value or Timer0, value is lower than the threshold Thd2 to avoid false alarms and false passing caused by measurement uncertainty. When the values of the timers Timer0 and Timer1 are higher than or equal to the threshold Thd2, $K_r$ is calculated according to equation (21). If the value of $K_r$ is out of a range set by thresholds Thd2 and Thd3, then, a fault is triggered, otherwise, the fault is cleared. After a decision of triggering or clearing fault is made or the pump control is not in the pressing stroke, the timers Timer0, and Timer1, and the variable Pc_a0 and Pc_a1 are cleared, and the routine ends.

When the buffer pressure is not controlled constant and there is no compressed air flow in the pump (e.g. the solenoid valve 510 is de-energized closed and the solenoid valve 520 is energized closed in FIG. 5), then similar to the relation revealed by the equation (16), the pressure change in the pump is an indication of the compressed air volume:

$$\frac{P_p}{V_{ap}} = -\frac{dP_p}{dV_{ap}} \tag{22}$$

, where $V_{ap}$ is the compressed air volume in the pump. According to equation (17), the pump pressure $P_p$ equals to the buffer pressure obtained from the pressure sensor when the injector nozzle is closed. Therefore, the compressed air volume $V_{ap}$ can be calculated by monitoring the pressure change when the injector nozzle is closed, $dP_p$, and the decrease in the compressed air volume, $-dV_{ap}$, which can be further calculated using the amount of fluid delivered through the injector 130 (FIG. 1) if the buffer volume change is neglected. When the buffer volume changes significantly compared to the amount of delivered fluid, i.e., when the buffer pressure $P_c$ changes significantly, a compensation calculated according to equation (1) for a spring buffer or according to equation (14) for an air trapped buffer is needed in calculating the $dV_{ap}$ value.

The compressed air volume is an indication of the fluid volume in the pump, and a suction mode needs to be triggered when the compressed air volume is higher than a threshold. An exemplary algorithm for a method of triggering suction modes using the pressure sensing values and fluid delivery commands can be realized by an interrupt service routine depicted in FIG. 6*b*. The interrupt is timer based, and runs periodically with the time interval EXEC_PERIOD. When the routine starts, the pump control status is examined. If it is in pressing stroke and there is no air flow (e.g. the solenoid valve 510 is de-energized closed and the solenoid valve 520 is energized closed in FIG. 5), then a variable, Total_flowV, is incremented by the product of the fluid delivery rate command and the time interval EXEC_PERIOD, otherwise the variable Total_flowV is cleared and the routine ends. After the calculation, if the value of Total_flowV is lower than or equal to a threshold Thd1, then the current value of Total_flowV is assigned to a variable Total_flow_baseV, and the injector status is examined. When the injector is de-energized, the pressure sensing value Pc0 is assigned to a variable Pc_p_baseV when it is steady. If the value of Total_flowV is higher than the threshold Thd1 and lower than a threshold Thd2, then the routine ends, otherwise, the compressed air volume $V_{ap}$ is calculated according to equation (22) when the pressure sensing value $P_{c0}$ is steady. If the $V_{ap}$ value is higher than a threshold Thd3, then a suction stroke is triggered, otherwise, the variable Total_FlowV is cleared. The routine ends thereafter.

The calculation of compressed air volume $V_{ap}$ in the pump can also be used for detecting the fluid level in the tank 100 (FIG. 1). In a suction stroke, when the compressed air in the pump is released, the fluid in the tank flows into the pump under the pressure difference between the tank and the pump, and the fluid mass flow rate, $\dot{m}_1$, is a function of the fluid level of the tank 100:

$$\dot{m}_1 = C_0 A_{n0} \sqrt{2\rho[\rho g(h_0 + h_1) - P_p]}, \tag{23}$$

where $A_{n0}$ is the minimum cross-section area in the fluid filling path from the tank to the pump; $C_0$ is the flow coefficient of the fluid filling path; $h_0$ is the fluid level in the tank, and $h_1$ is the height difference between the bottom of the tank and the fluid inlet port 502 (FIG. 5) of the pump. Assuming the pump pressure $P_p$ quickly decreases to 0 in a suction stroke, and the change of the tank fluid level, $h_0$, during a suction stroke is negligible, then according to equation (23), in a pressing stroke, when a compressed air volume value $V_{ap}$ is measured, the tank fluid level $h_0$ can be calculated using the following equation:

$$h_0 = \frac{(V_p - V_{ap} + V_d)^2}{2gC_0^2 A_{n0}^2 T_f^2} - h_1 \tag{24}$$

where $T_f$ is the duration time of the suction stroke right before the pressing stroke; $V_p$ is the total volume of the pump, and $V_d$ is the volume of the fluid delivered through the injector 130 (FIG. 1) when the trapped air volume $V_{ap}$ is calculated (e.g. the Total_flowV in the algorithm of FIG. 6*b* when the value of $V_{ap}$ is calculated). Note that when the time $T_f$ is long enough for the refill fluid to fill all the usable pump volume, i.e., the value of $V_{ap}-V_d$ reaches its lowest value, then the value calculated using equation (24) will be lower than the actual fluid level due to saturation effect. To avoid introducing errors caused by long refill time, a screening condition can be used for only calculating the tank fluid level when saturation is not reached. Additionally, if the releasing time of the compressed air is long, then the pump pressure $P_p$ will also play a role in the calculation of tank fluid level. In this case, the calculated fluid level needs to be compensated using the pump pressure $P_p$, which can be calculated using the pressure sensing value $P_c$ when the injector nozzle is opened right before a suction stroke starts.

Figure 6B:
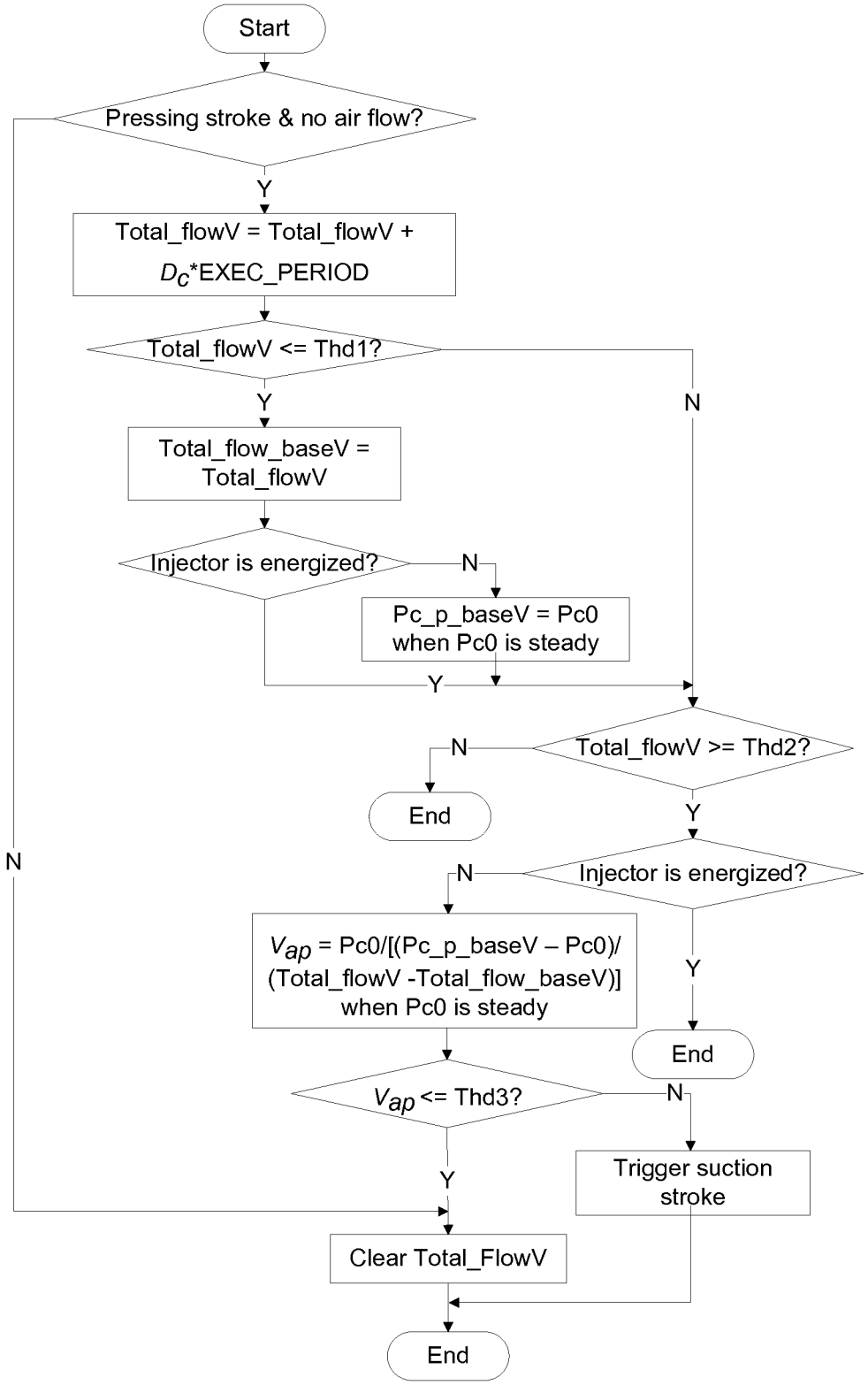
FIG. 6*b* is a flow chart of an interrupt service routine for an air driven pump controller to trigger a suction stroke.
Figure 6C:
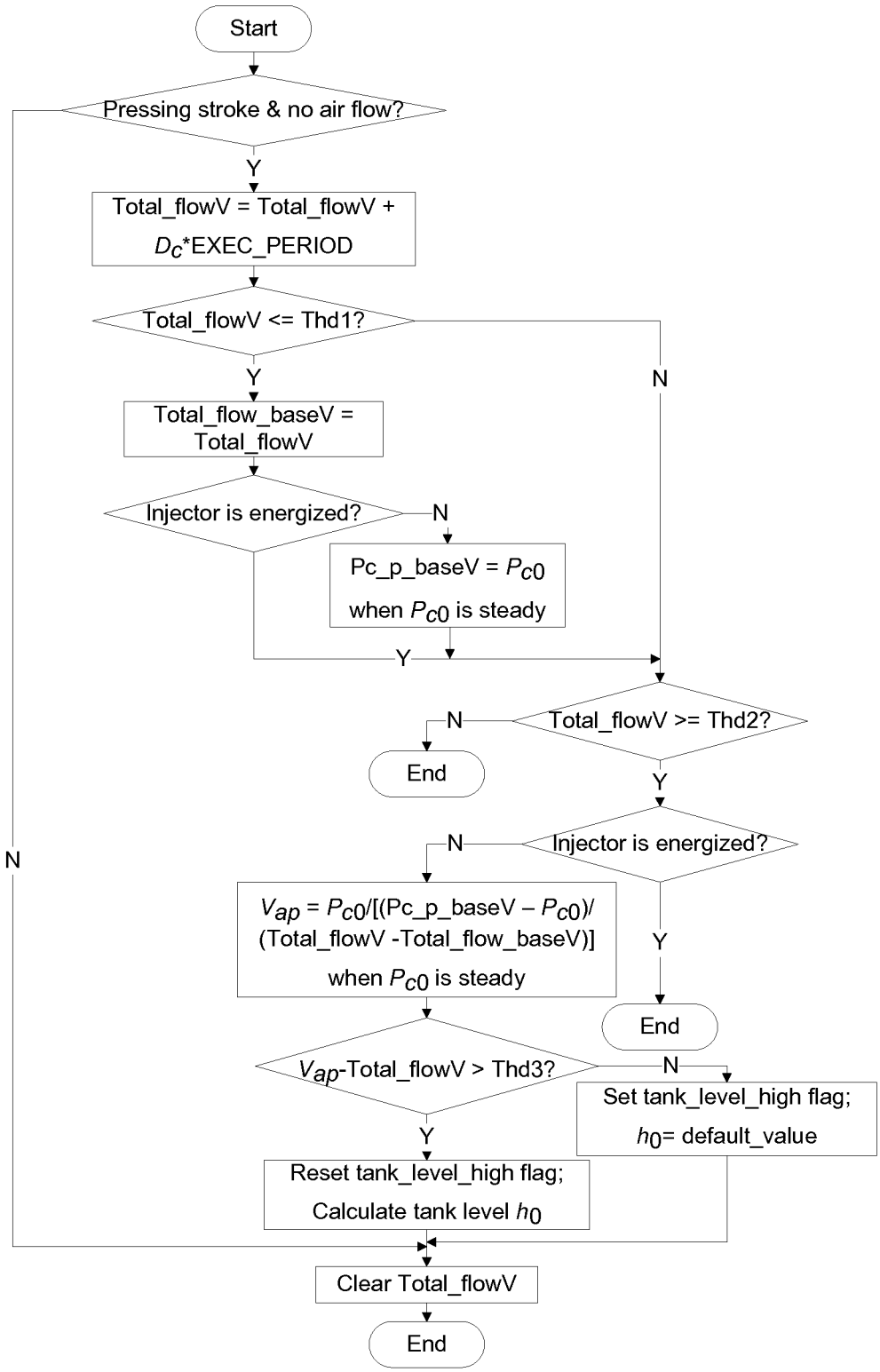
FIG. 6*c* is a flow chart of an interrupt service routine for detecting tank level using sensing values obtained from a pressure sensor positioned in a buffer of a fluid delivery apparatus with an air driven pump.

An algorithm for calculating the tank fluid level can be realized with an interrupt service routine extended from the one of FIG. 6*b*. Referring to FIG. 6*c*, a screen condition in calculating the tank fluid level is the difference between the values of $V_{ap}$ and Total_flowV is higher than a threshold Thd3. After the compressed air volume $V_{ap}$ in the pump is calculated, if the screen condition is satisfied, then the tank level $h_0$ is calculated according to equation (24) and a tank_level_high flag is reset, otherwise, the tank_level_high flag is set, and a default value is set to $h_0$.

Figure 7A:
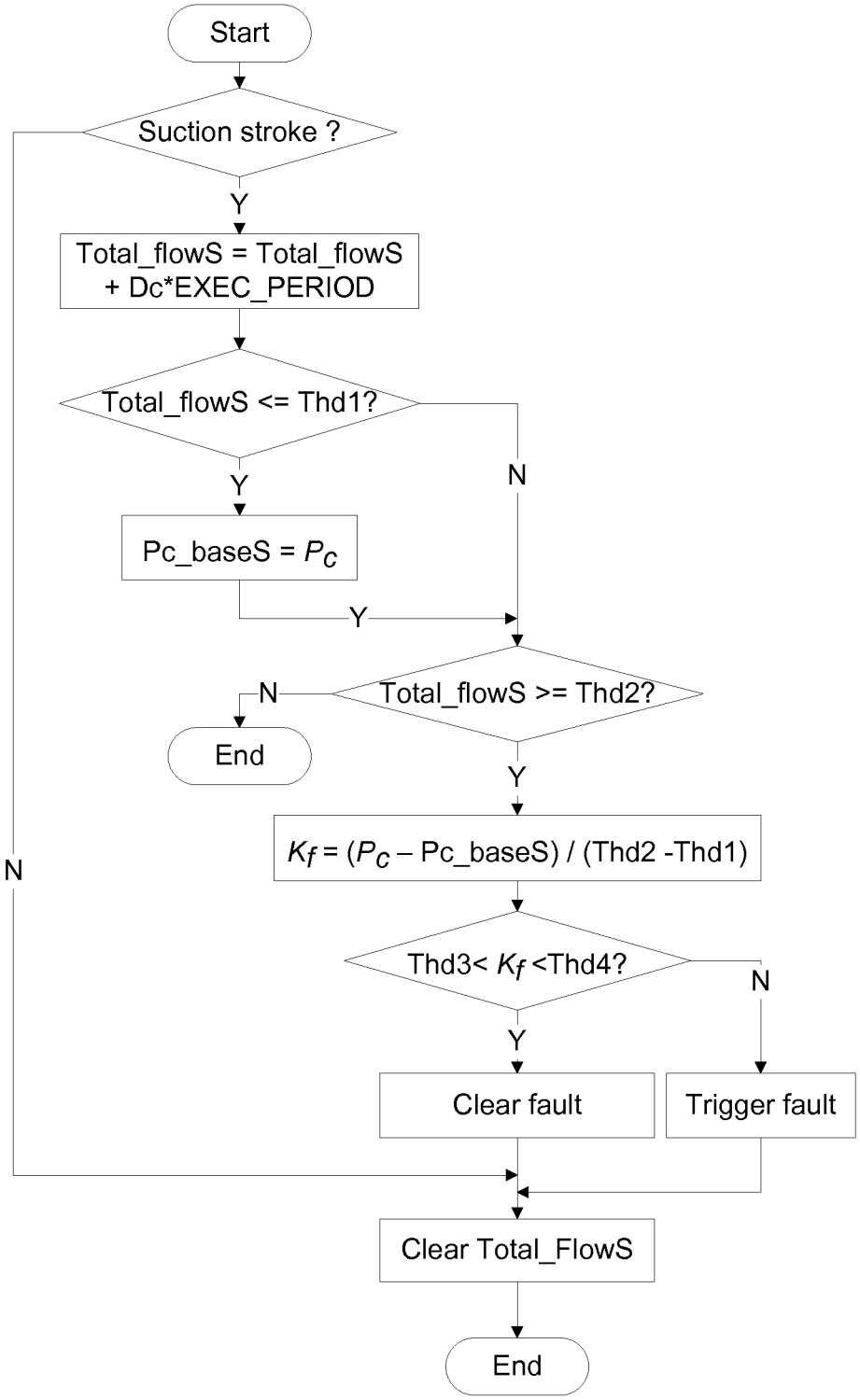
FIG. 7*a* is a flow chart of an interrupt service routine for a diagnostic controller to detect issues in the fluid delivery path of a fluid delivery apparatus with an air driven pump and a spring buffer.

In a suction stroke, since the fluid flow is provided solely by the buffer, pressure inside spring buffers and air trapped buffers change differently when fluid is released from the buffers. When a spring buffer of FIG. 2 is used, according to equation (1), the fluid volume change in the buffer is proportional to the pressure change in the buffer. This relation can be used for triggering a pressing stroke, i.e., when the pressure in the buffer is below a threshold, a pressing stroke needs to be triggered to avoid issues in fluid flow rate control. Furthermore, according to equation (1), in a suction stroke, the buffer pressure change is a function of fluid delivery rate command:

$$\frac{dP_c}{dt} = D_c K_f = D_c K_s / \rho A_p^2 \tag{25}$$

wherein $K_f$ is the ratio of the buffer pressure changing rate to the commanded fluid delivery rate. This relation can be used for diagnosing issues in the fluid flow path from the buffer to the injector, including that in the injector and the injection control. An example of such a diagnostic algorithm can be realized by an interrupt service routine for a time based interrupt with time interval of EXEC_PERIOD, as shown in FIG. 7*a*. In this routine, the pump control status is examined first. If the pump control is in a suction stroke, a variable, Total_flowS, is incremented by the product of the fluid delivery rate command $D_c$ and the time interval EXEC_PERIOD, otherwise the variable Total_FlowS is cleared and the routine ends. After the calculation, if the value of Total_FlowS is lower than or equal to a threshold Thd1, then the current pressure sensing value, $P_c$, is assigned to a variable Pc_baseS. If the value of Total_FlowS is higher than the threshold Thd1 and lower than another threshold Thd2, then the routine ends, otherwise, the ratio $K_f$ is calculated according to equation (25). If the $K_f$ value is out of a range set by a lower limit of Thd3 and an upper limit of Thd4, then a fault is triggered, otherwise the fault is cleared. The variable Total_FlowS is cleared before the routine ends.

Figure 7B:
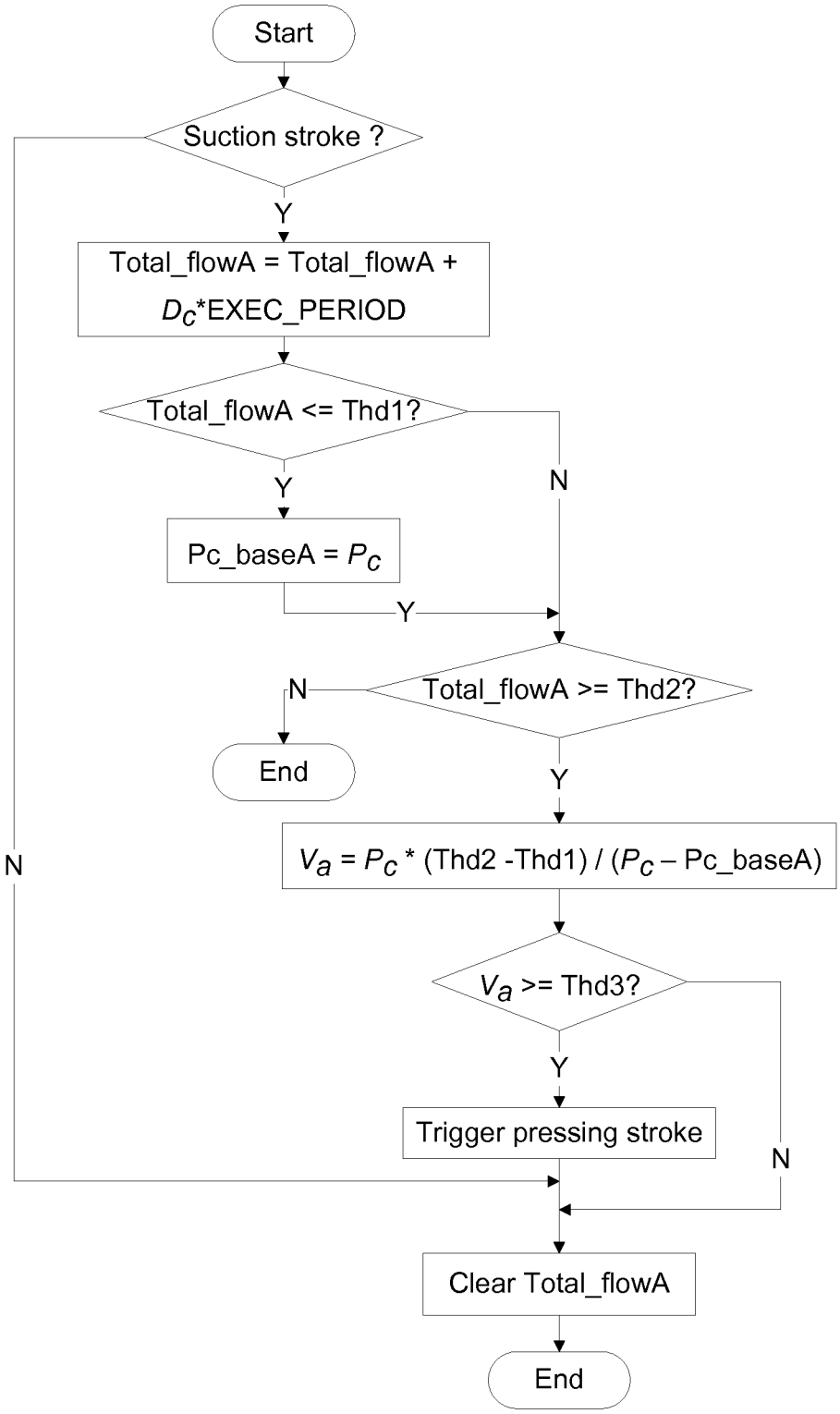
FIG. 7*b* is a flow chart of an interrupt service routine for an air driven pump controller to trigger a pressing stroke in a fluid delivery apparatus with an air driven pump and a buffer with air trapped inside.

When the air trapped buffer of FIG. 4 is used, according to equation (16), the coefficient between the change of the pressure sensing value and that of the fluid volume in the buffer is no longer a constant. It is determined by the volume and pressure of trapped air. Using the relation revealed by equation (16), the volume of trapped air in the buffer can be calculated and a pressing stroke can be triggered therewith. An example of such an algorithm can be realized by an interrupt service routine triggered by a time interrupt with interval of EXEC_PERIOD, as shown in FIG. 7*b*. The routine starts with checking if the pump control is in a suction stroke. If it is in a suction stroke, then a variable Total_flowA is incremented by the product of the fluid delivery rate $D_c$ and the time interval value EXEC_PERIOD, otherwise, the variable Total_flowA is cleared and the routine ends. After the calculation of Total_flowA, its value is compared to a threshold Thd1. The value of a variable Pc_baseA is updated with the current pressure sensing value $P_c$ if the value of Total_flowA is lower than or equal to the threshold Thd1. The value of Total_flowA is then compared with another threshold Thd2. If it is lower than Thd2, then the routine ends, otherwise, the trapped air volume $V_a$ is calculated according to equation (16). If $V_a$ is higher than a threshold Thd3, then a pressing stroke is triggered. The routine clears the variable Total_FlowA before it ends.

According to equation (16), the volume and pressure of trapped air determines the damping capability of the buffer. To have a smaller change of $P_c$, a larger volume the trapped air is needed. However, since the trapped air in the buffer can be dissolved in the fluid causing volume loss during fluid delivery, to keep an acceptable damping performance, the trapped air needs to be. A method for refilling the trapped air is energizing open a solenoid (e.g. solenoid 401 in FIG. 4) fluidly connected to a compressed air source to fill compressed air into the buffer. In this method, we need to detect the low volume of trapped air and control the amount of filled compressed air.

Figure 7C:
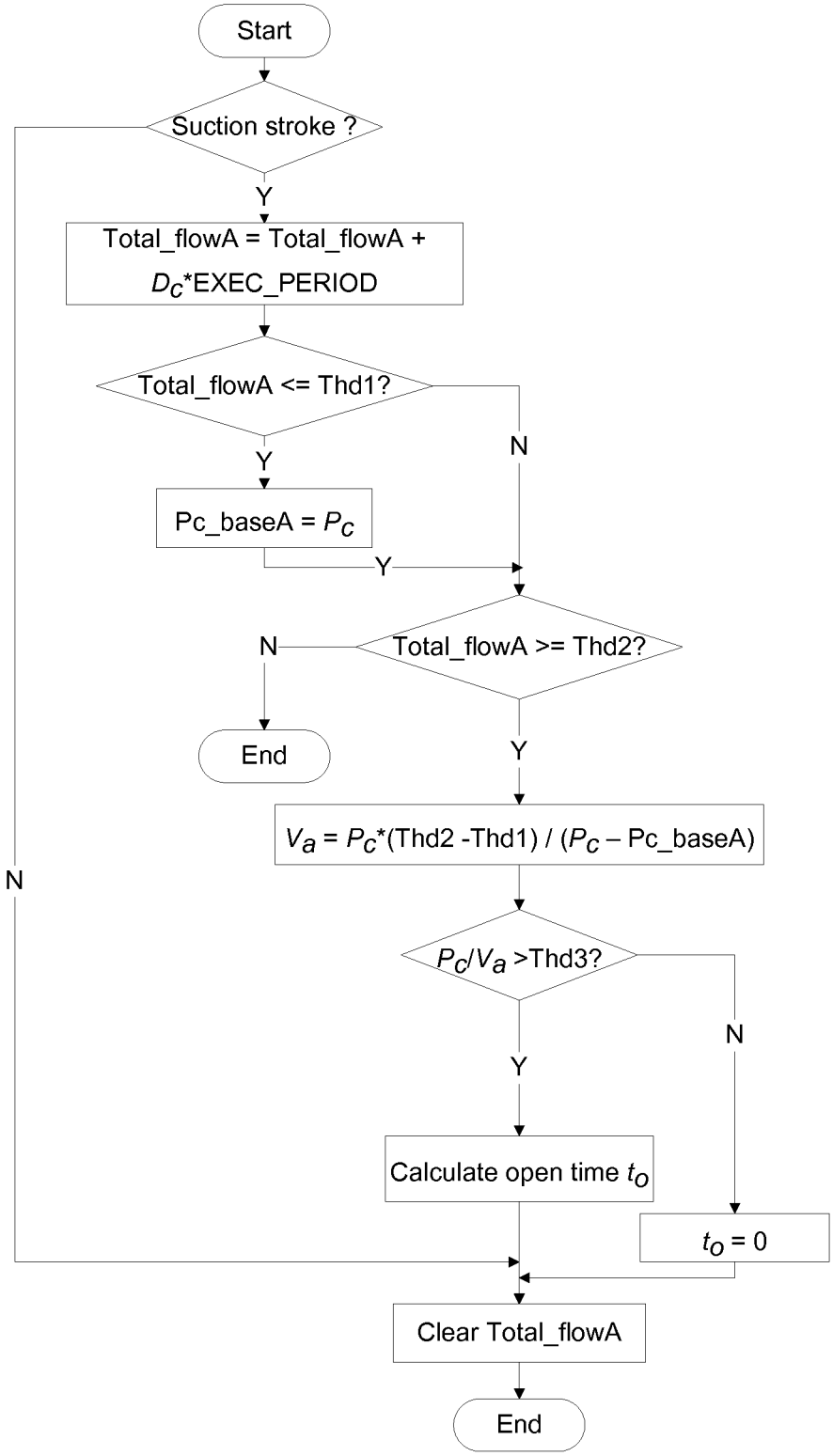
FIG. 7*c* is a flow chart of an interrupt service routine for an air refill controller to refill trapped air into a buffer of a fluid delivery apparatus.

The trapped air volume can be calculated according to equation (16), and a control algorithm for refilling the trapped air can be realized by an interrupt service routine extended from the one of FIG. 7*b*. Referring to FIG. 7*c*, the refilling control algorithm compares the value of $P_c/V_a$ to a threshold Thd3 after $V_a$ is calculated. If it is higher than the threshold, then a refill time $t_0$ is calculated for a control pulse to energize the refill solenoid (e.g. solenoid 401 in FIG. 4), otherwise, the refill time is set to 0. Two methods can be used in calculating to. One is setting a constant value to $t_0$. The constant value is the minimum open time that increases the value of $P_c/V_a$ from Thd3 to a target value $K_t$. If in the next calculation, the value of $P_c/V_a$ is still lower than Thd3, then another control pause is generated to open the solenoid valve for the period of time $t_0$ until the value of $P_c/V_a$ is higher than or equal to Thd3. Another method is calculating $t_0$ based on the buffer pressure $P_c$, the compressed air pressure $P_a$, and the ambient temperature $T_a$. According to equation (16), to reach the target value $K_t$, the amount of compressed air needs to be refilled is $\Delta n$, and $$K_t = \frac{(n+\Delta n)RT_a}{V_a^2} = \frac{P_c V_a + \Delta n R T_a}{V_a^2} \tag{26}$$

With the compressed air pressure of $P_a$, the time needed for the refill is determined by the following equation:

$$\Delta n = \int_0^{t_0} C_f A_{nf} \sqrt{2\rho_a (P_a - P_c)}\, dt, \tag{27}$$

where $\rho_a$ is the density of the compressed air; $A_{nf}$ is the minimum cross-section area in the compressed air refill path to the buffer, and $C_f$ is the flow coefficient of the compressed air refill path. If the change of $P_c$ is negligible, then according equations (26)-(27), the open time $t_0$ can be calculated using the following equation:

$$t_0 = \frac{(K_t V_a^2 - P_c V_a)}{C_f A_{nf} R T_a \sqrt{2\rho_a (P_a - P_c)}} \tag{28}$$

The controls and diagnosic algorithms for a fluid delivery apparatus with different pumps with buffers in the present invention are summarized in the following table.

TABLE 1

Summary table

| Pumps and Control/ Diagnosis Algorithms | | Spring buffer | Trapped air buffer |
|---|---|---|---|
| Motor driven pump | System diagnosis | FIG. 3a-3b, equations (11), (12) | FIG. 3a-3b, Equations (11), (12), (16) |
| | Refill trapped air in buffer | N/A | Not capable (no suction stroke) |
| Air driven pump | System diagnosis | FIG. 6a, equations (20), (21) | FIG. 6a, equations (20), (21) |
| | Injection component diagnosis | FIG. 7a, Equation (25) | Not capable |
| | Triggering pressing stroke | Equation (1) | FIG. 7b, equation (16) |
| | Triggering suction stroke | FIG. 6b equation (22) | FIG. 6b equation (22) |
| | Tank fluid level detection | FIG. 6c equation (24) | FIG. 6c equation (24) |
| | Refill trapped air in buffer | N/A | FIG. 7c equations (16), (28) |

What is claimed:

1. A fluid delivery apparatus with a diagnostic system, comprising:

a pump driving fluid into a buffer which is fluidly coupled to said pump;

a pressure sensor providing a sensing signal indicative of a fluid pressure in said buffer;

a nozzle fluidly coupled to said buffer for releasing fluid;

a fluid delivery controller for controlling a fluid delivery rate configured to open and close said nozzle in response to a fluid delivery rate command; and a diagnostic controller for determining anomaly of said fluid delivery apparatus configured to calculate a pressure difference value with a first pressure sensing value obtained from said sensing signal at a first moment and a second pressure sensing value obtained from said sensing signal at a second moment, and calculate a total fluid delivery amount in between said first moment and said second moment with said fluid delivery rate command, and further configured to calculate an expected pressure change value according to at least said total fluid delivery amount and determine whether a difference between said pressure difference value and said expected pressure change value is within a predetermined range.

2. The fluid delivery apparatus of claim 1, wherein said pump is a motor driven pump with a motor driven by an electrical signal, and said diagnostic controller is further configured to calculate said expected pressure change according to a sensed power value of said electrical signal.

3. The fluid delivery apparatus of claim 2, wherein said diagnostic controller is further configured to calculate said expected pressure change according to a pumping flow rate value calculated using said sensed power value and pressure sensing values obtained from said sensing signal.

4. The fluid delivery apparatus of claim 1, wherein said buffer has air trapped inside, and said diagnostic controller is configured to calculate said expected pressure change in response to at least a ratio of a change in said fluid pressure calculated with pressure sensing values obtained from said sensing signal to a fluid volume change in said buffer calculated according to at least said fluid delivery rate command.

5. The fluid delivery apparatus of claim 1, wherein said buffer has air trapped inside, and said diagnostic controller is further configured to calculate said expected pressure change in response to a ratio of a pressure sensing value obtained from said sensing signal to a volume of trapped air in said buffer.

6. The fluid delivery apparatus of claim 1, wherein said buffer is a spring buffer with a piston disposed inside a buffer body and a spring for proving a linear relationship between a fluid volume and said fluid pressure in said spring buffer.

7. A fluid delivery apparatus, comprising:

a tank for containing a fluid to be delivered;

an air driven pump having a first port fluidly coupled to a compressed air source, a second port for releasing compressed air, a third port fluidly coupled to said tank, and a forth port fluidly coupled to a buffer;

a pressure sensor providing a sensing signal indicative of a fluid pressure in said buffer;

a nozzle fluidly coupled to said buffer for releasing fluid;

a pump controller configured to operate said pump with a suction stroke, in which compressed air is released from said pump through said second port and said fluid in said tank is filled into said pump through said third port, and a pressing stroke, in which compressed air is filled into said pump through said first port and a pressure is built inside said pump; and a fluid delivery controller for controlling a fluid delivery rate configured to open and close said nozzle according to a fluid delivery rate command;

wherein said pump controller is further configured to switch in between said pressing stroke and said suctions stroke in response to at least pressure values obtained from said sensing signal.

8. The fluid delivery apparatus of claim 7, wherein said pump controller is further configured to switch from said pressing stroke to said suction stroke in response to a compressed air volume value calculated using at least said pressure values obtained from said sensing signal when said nozzle is closed.

9. The fluid delivery apparatus of claim 8, wherein said compressed air volume value is further calculated by using at least said pressure values obtained from said sensing signal when compressed air is trapped in said pump with both of said first port and said second port of said pump being closed.

10. The fluid delivery apparatus of claim 8, further comprising:

a diagnostic controller for detecting anomaly of said fluid delivery apparatus configured to determine whether a coefficient value, which is calculated according to at least two pressure values obtained from said sensing signal when said nozzle is closed, is within a predetermined range.

11. The fluid delivery apparatus of claim 10, wherein said at least two pressure values are obtained when said pump controller operates in said pressing stroke.

12. The fluid delivery apparatus of claim 7, further comprising:

a tank fluid level sensing means providing a level value indicative of a fluid level in said tank in response to at least a duration time of said suction stroke and a compressed air volume value calculated using at least said pressure values obtained from said sensing signal.

13. The fluid delivery apparatus of claim 7, wherein said pump controller is further configured to switch from said suction stroke to said pressing stroke in response to a volume value indicative of a fluid volume in said buffer calculated using at least said pressure values obtained from said sensing signal.

14. The fluid delivery apparatus of claim 7, wherein said buffer is a spring buffer with a piston disposed inside a buffer body and a spring for proving a linear relationship between a fluid volume and said fluid pressure in said spring buffer.

15. The fluid delivery apparatus of claim 14, further comprising:

a diagnostic controller for detecting anomaly of said fluid delivery apparatus configured to determine whether a ratio of a difference between two said pressure values obtained at two moments in said suction stroke to a delivered fluid amount value calculated using at least said fluid delivery rate commands in between said two moments is within a predetermined range.

16. The fluid delivery apparatus of claim 7, wherein said buffer has air trapped inside.

17. The fluid delivery apparatus of claim 16, wherein said pump controller is further configured to switch from said suction stroke to said pressing stroke in response to a volume value indicative of a trapped air volume in said buffer calculated using at least pressure values obtained from said sensing signal.

18. The fluid delivery apparatus of claim 16, further comprising:

an air refill means for refilling trapped air into said buffer.

19. The fluid delivery apparatus of claim 18, wherein said air refill means includes a solenoid valve fluidly connected to a compressed air source.

20. The fluid delivery apparatus of claim 19, further comprising:

an air refill controller configured to operate said air refill means in response to at least a ratio of a difference between two pressure values obtained at two moments in said suction stroke to a volume change value calculated using at least said fluid delivery rate commands in between said two moments.

* * * * *